US007264135B2

(12) United States Patent
Savicki et al.

(10) Patent No.: US 7,264,135 B2
(45) Date of Patent: Sep. 4, 2007

(54) STACKABLE CONTAINER LID

(75) Inventors: Alan F. Savicki, Yorkville, IL (US); Jason Maxwell, Elgin, IL (US)

(73) Assignee: The Glad Products Company, Oakland, CA (US)

( * ) Notice: Subject to any disclaimer, the term of this patent is extended or adjusted under 35 U.S.C. 154(b) by 407 days.

(21) Appl. No.: 10/793,090

(22) Filed: Mar. 4, 2004

(65) Prior Publication Data

US 2005/0194390 A1 Sep. 8, 2005

(51) Int. Cl.

| | |
|---|---|
| ***B65D 43/03*** | (2006.01) |
| ***B65D 43/10*** | (2006.01) |
| ***B65D 41/16*** | (2006.01) |
| *B65D 21/00* | (2006.01) |
| *B65D 43/06* | (2006.01) |

(52) U.S. Cl. ..... 220/781; 206/509; 206/515; 220/793

(58) Field of Classification Search ..... 206/501, 206/514, 505–509, 517, 515; 220/781, 380, 220/793, 794

See application file for complete search history.

(56) References Cited

U.S. PATENT DOCUMENTS

| | | | | | |
|---|---|---|---|---|---|
| 2,412,325 | A | | 12/1946 | Devine et al. | |
| 3,701,456 | A | * | 10/1972 | Alroy et al. | 206/520 |
| 3,895,743 | A | * | 7/1975 | Christian | 222/143 |
| 3,912,118 | A | * | 10/1975 | Bird | 206/508 |
| 3,931,890 | A | | 1/1976 | Davis | |
| 3,967,731 | A | | 7/1976 | Boduch | |
| 4,076,123 | A | | 2/1978 | Davis | |
| 4,144,968 | A | * | 3/1979 | Shelton | 206/509 |
| 4,275,815 | A | * | 6/1981 | Davis | 206/508 |
| 4,421,244 | A | | 12/1983 | Van Melle | |
| 4,703,857 | A | | 11/1987 | Jahnen et al. | |
| 4,747,510 | A | | 5/1988 | Mack | |
| 4,811,860 | A | * | 3/1989 | Sorenson et al. | 220/380 |
| 4,877,151 | A | | 10/1989 | Rush et al. | |
| 4,886,184 | A | | 12/1989 | Chamourian | |
| 5,036,980 | A | * | 8/1991 | Vigue et al. | 206/515 |
| 5,170,696 | A | * | 12/1992 | Reed | 99/349 |
| 5,377,860 | A | * | 1/1995 | Littlejohn et al. | 220/790 |
| 5,377,861 | A | * | 1/1995 | Landis | 220/380 |
| 5,385,255 | A | | 1/1995 | Varano et al. | |
| 5,419,451 | A | | 5/1995 | Bitel | |

(Continued)

FOREIGN PATENT DOCUMENTS

| | | |
|---|---|---|
| DE | 3904266 | 8/1990 |

*Primary Examiner*—Anthony D. Stashick
*Assistant Examiner*—Niki M. Eloshway
(74) *Attorney, Agent, or Firm*—Thomas C. Feix

(57) ABSTRACT

A stackable container lid comprising a lid member (80) having a center portion (83*a*), an edge portion (83*b*) top and bottom surfaces (82, 84) and closure means (88) adapted to cooperate with the closure device of a container bottom, the lid top surface (82) including a raised boss (100), the raised boss (100) being disposed in the lid member center portion (83*a*) and projecting outwardly from the lid member top surface (82), the lid bottom surface (84) including a boss seat (108) adapted to receive the raised boss (100) of another said lid. The raised boss (100) and the boss seat (108) of another said lid are engagable by exerting a force on the lid top surface (82) of said another lid proximate the raised boss (100) of said another lid.

44 Claims, 8 Drawing Sheets

U.S. PATENT DOCUMENTS 5,634,559 A * 6/1997 Foos et al. ..... 206/518
5,692,617 A 12/1997 Adams
5,699,925 A * 12/1997 Petruzzi ..... 220/4.27
5,791,509 A * 8/1998 Rush et al. ..... 220/781
5,881,880 A 3/1999 Jacques et al.
5,894,953 A * 4/1999 Ramirez ..... 220/785
5,979,690 A 11/1999 Hartley
6,170,969 B1 1/2001 Dumse
6,427,864 B1 * 8/2002 Asselin ..... 220/709

* cited by examiner

STACKABLE CONTAINER LID

FIELD OF THE PRESENT INVENTION

The present invention relates generally to reclosable container and lid assemblies. More particularly, the invention relates to stackable container lids.

BACKGROUND OF THE INVENTION

Rigid thermoplastic food containers can be classified into two distinct categories. The first category of containers comprises containers that the consumer acquires during the purchase of dairy or deli foods at a retail store. A container in this category is often referred to as an "inexpensive" container, since it is usually the consumer's intention is to purchase the food in the container irrespective of the type of container. Since the consumer pays the retail price necessary to purchase the food, they often deem the container an inexpensive item that they can save for re-use at a later date.

With respect to this first category of container, a sub or first group includes the inexpensive convenience containers that consumers frequently acquire when purchasing deli foods. Generally, these "deli" containers need only to perform the function of providing a highly visible display and to provide containment of solid foods, such as, bakery items, salads or fruit, at refrigeration temperature to ambient temperature. The noted containers are often manufactured into many shapes by a thermoforming process so as to provide a wall thickness of about 10-20 mils. This wall thickness range represents the low end of wall thicknesses generally seen in rigid thermoplastic food containers and, as a consequence, the containers can be made very inexpensively. Thus, the consumer may deem the container disposable, i.e., discardable without significant monetary loss that can be attributed to the cost of acquiring the container.

"Dairy" containers, which are designed to hold butters, fresh and processed cheeses, yogurts, and read-serve sauces at retail, represent a second group of thermoplastic containers that can be characterized as "inexpensive". Like the "deli" containers, the "dairy" containers can be made very inexpensively and, as such, the consumer may similarly deem the container disposable after limited re-use.

The noted "inexpensive" containers typically include a removable rigid thermoplastic lid that is adapted to engage the container bottom. To enhance sealing of the container, the lid is often placed over a foil or thermoplastic barrier film (i.e., lidding material).

The second category of food containers consists of expensive durable containers, which generally utilize more expensive plastic materials and thick container walls. These containers address the shortcomings of the inexpensive containers in that they may be suitable for microwave, dishwasher, and freezer use and provide a secure seal that will not leak. The noted containers also employ thicker, more durable lids.

One frustration that consumers have experienced with conventional container lids is organizing and, hence, storing of the lids. Indeed, the lids are often misplaced and difficult to find. Storing of the lids is typically addressed by incorporating stacking features to facilitate stacking or nesting of the lids.

Various lid designs have been employed to facilitate stacking. One commonly employed design comprises the provision of circular peripheral sealing ribs of somewhat U-shaped cross section that are adapted to be introduced into container openings. Stackable container lids of this kind typically include a ring-shaped, flat outwardly radially-extending peripheral flange that surrounds the sealing rib and serves as a retainer rim to be fused or sealed to the opening of the container. The stacking seating surfaces of the lids are rounded at the bottom of the sealing rib and interact with correspondingly rounded edges of an underlying identical lid at those transition points of the latter which are disposed between the inner peripheral wall of the sealing rib and the lid bottom or body, and/or at the transition points which are disposed between the outer peripheral wall of the underlying sealing rib and the associated peripheral flange or retainer rim.

A further stackable lid design includes beveled locking elements that are disposed in the snap of the container lid, the rim extending essentially downwardly and being adapted to lock over the peripheral rim of the container. The beveled locking elements are adapted to the height of the stacking ring means and with respect to the annular stacking seating surfaces of the lid such that when the elements slide over the transition rim of an identical underlying lid, the overlying stacking ring means can be readily lifted out of the circular opening or slot formed by the annular groove in the top side of the ring in the lower lid.

There are several drawbacks and disadvantages associated with prior art stackable containers. First, since the stacking means (or configuration) is disposed proximate to or an integral feature of the outer flange and/or sealing means of the lid, the stacking means only facilitates stacking of "identical" or "substantially similar" lids (i.e., same size and configuration). Second, stacking of such lids can, and in many instances will, overstress the flange and, hence, sealing means, which will have an adverse impact on the sealing integrity. Third, since the noted lids are engaged proximate the periphery, disengaging the lids is often difficult. Finally, none of the prior art lid designs address the issues of lid control and organization.

It would thus be advantageous to provide a durable container lid that is adapted to tightly seal a container, includes stacking means that facilitates stacking of a plurality container lids having similar and dissimilar sizes and configurations, and, after being engaged to another like lid, can be readily disengaged therefrom. As will be appreciated by one having ordinary skill in the art, a lid having the noted features would make organizing and storing of multiple lids easier and more convenient.

SUMMARY OF THE INVENTION

In one embodiment of the invention, the stackable container lid of the invention comprises a lid member having a center portion, an edge portion, top and bottom surfaces and closure means, the closure means being disposed proximate the edge portion and adapted to cooperate with the closure device of the container, the lid top surface including an engagement member, the engagement member being disposed in the lid member center portion and projecting outwardly from the top surface, the lid bottom surface including a recessed bottom region adapted to receive the engagement member of another said lid.

The engagement member and the recessed bottom region of another said lid are engagable by exerting a force on the lid top surface of said another lid proximate the engagement member of said another lid.

In a preferred embodiment of the invention, the lid bottom surface includes a stacking seat and the lid top surface includes a stacking recess that is adapted to receive the lid stacking seat of another said lid.

In one embodiment of the invention, the stacking recess is substantially rectangular in shape.

In another embodiment of the invention, the stacking recess is substantially circular in shape.

In a preferred embodiment, the engagement member has a height in the range of approximately 0.125-0.500 in.

In another embodiment of the invention, the stackable container lid comprises a lid member having an inner portion, an edge portion, top and bottom surfaces and closure means disposed proximate the edge portion and adapted to cooperate with the closure device of a container bottom, the lid top surface including a stacking boss, the stacking boss being disposed in the inner portion and projecting outwardly from the top surface, the lid bottom surface including a boss seat adapted to receive the stacking boss of another lid.

The stacking boss and boss seat of another said lid are engagable by exerting a force on the lid top surface of the another said lid proximate the stacking boss of the another said lid.

The invention also provides for a method of stacking container lids, comprising the steps of (i) providing at least first and second lid members, each of the first and second lid members having a center portion, an edge portion, and top and bottom surfaces, the lid top surface including an engagement member, the engagement member being disposed in the lid member center portion and projecting outwardly from the top surface, the lid bottom surface of the first lid member including a recessed bottom region adapted to receive the engagement member of the second lid member, the engagement member of the second lid member and the recessed bottom region of the first lid member being engagable by exerting a force on the lid top surface of the first lid member proximate the engagement member of the first lid member; (ii) placing the first and second lid members in a pre-engaged orientation whereby the engagement member of the second lid member and the recessed bottom region of the first lid member are aligned; and (iii) exerting an engagement force on the lid top surface of the first lid member proximate the engagement member of the first lid member while the second lid member is maintained in a substantially stationary position.

In one embodiment, the first and second lid members have a substantially similar configuration and size.

In a further embodiment, the first and second lid members have a dissimilar configuration and size.

BRIEF DESCRIPTION OF THE DRAWINGS

Further features and advantages will become apparent from the following and more particular description of the preferred embodiments of the invention, as illustrated in the accompanying drawings, and in which like referenced characters generally refer to the same parts or elements throughout the views, and in which.

DETAILED DESCRIPTION OF THE INVENTION

Before describing the present invention in detail, it is to be understood that this invention is not limited to particularly exemplified container lid designs, configurations or sizes, materials and methods as such may, of course, vary. Thus, although a number of container lid designs and configurations similar or equivalent to those described herein can be used in the practice of the present invention, the preferred container lid designs and configurations are described herein.

It is also to be understood that the terminology used herein is for the purpose of describing particular embodiments of the invention only and is not intended to be limiting.

Unless defined otherwise, all technical and scientific terms used herein have the same meaning as commonly understood by one having ordinary skill in the art to which the invention pertains.

Further, all publications, patent and patent applications cited herein, whether supra or infra, are hereby incorporated by reference in their entirety.

Finally, as used in this specification and the appended claims, the singular forms "a "an" and "the" include plural referents unless the content clearly dictates otherwise. Thus, for example, reference to "an embossed region" includes two or more such regions; reference to "a container boss" includes two or more such bosses and the like.

Figure 1:
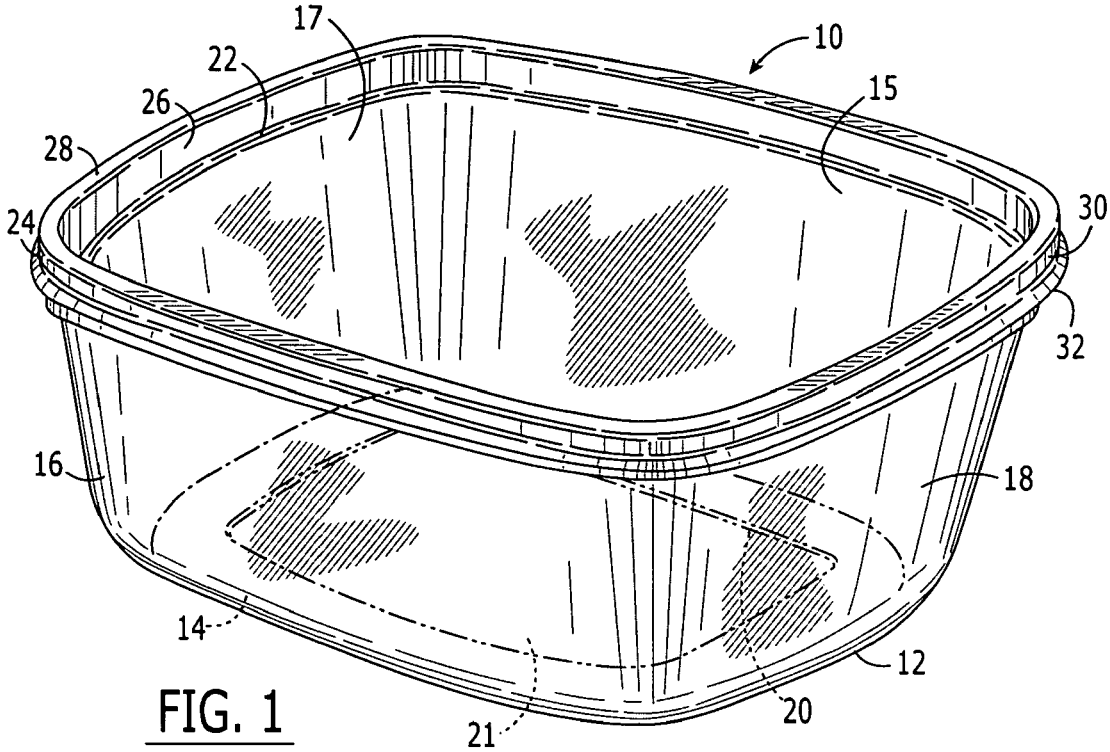
FIG. 1 (PRIOR ART)
FIG. 1 is a top perspective view of a prior art container bottom.

Referring first to FIG. 1, there is shown a conventional container 10. The container 10 consists of a flexible plastic container bottom 12, which is sealably closed by a flexible plastic container lid 40 (see FIG. 2).

As illustrated in FIG. 1, the container bottom 12, has a bottom surface 14, four sidewalls 15, 16, 17, 18, a stacking recess 20, a denesting shoulder 22, and a closure device 24.

The sidewalls 15, 16, 17, 18 extend upwardly and slightly outwardly from the periphery of the bottom surface 14. At the termination of the sidewalls 15, 16, 17, 18 an outwardly and substantially horizontally extending denesting shoulder 22 is provided, which merges into the base of the closure device 24. The bottom surface 14 also includes a stacking recess 20 extending upwardly to an upper substantially horizontal surface 21.

Figure 3:
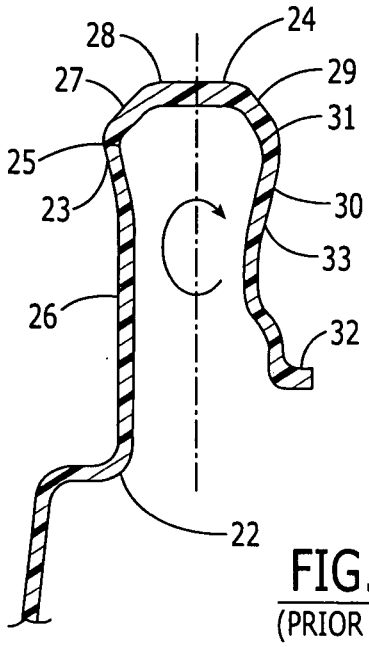
FIG. 3 (PRIOR ART)
FIG. 3 is a partial side view of a prior art container closure device.
Figure 4:
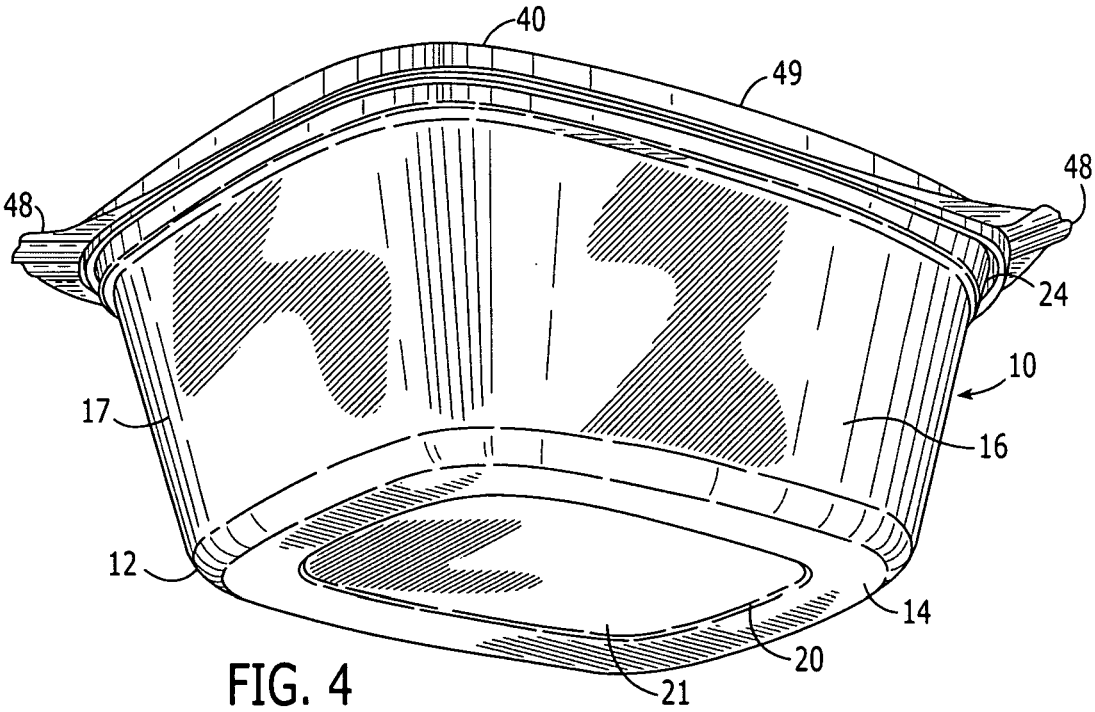
FIG. 4 (PRIOR ART)
FIG. 4 is a side elevation view of a prior art container bottom and lid assembly.

Referring to FIG. 3, the closure device 24 includes an inner sealing wall 26, a retention bead 28, an outer wall 30 and a skirt 32. The sealing wall 26 preferably extends from the denesting shoulder 22 and merges into the retention bead 28.

As illustrated in FIG. 3, the inner wall 26 extends from the denesting shoulder 22 and merges into the retention bead 28. The retention bead 28 can include at least one upwardly and outwardly extending cut-back portion 23, an inner vertical portion 25, an upwardly and inwardly extending lead-in portion 27, a downwardly and outwardly extending lead-in portion 29, an outer vertical portion 31, and a downward and inwardly extending cut-back portion 33.

Further details of the container 10 shown in FIGS. 1-4 are set forth in U.S. Pat. No. 6,170,696, which is incorporated herein in its entirety.

As set forth in the '696 patent, the containers 10 can be stacked (or nested) together in a stacked orientation. When the containers 10 are stacked, the denesting shoulder 22 of the upper container bottom 12 rests on the upwardly and inwardly extending lead-in-position 27 of the container bottom 12. Preferably, the inner sealing wall 26 of the container bottom 12 is designed and adapted to maintain an air space between the sidewalls of the lower container bottom and the sidewalls of the upper container bottom such that the interlocking of container of container bottom is avoided.

Figure 2:
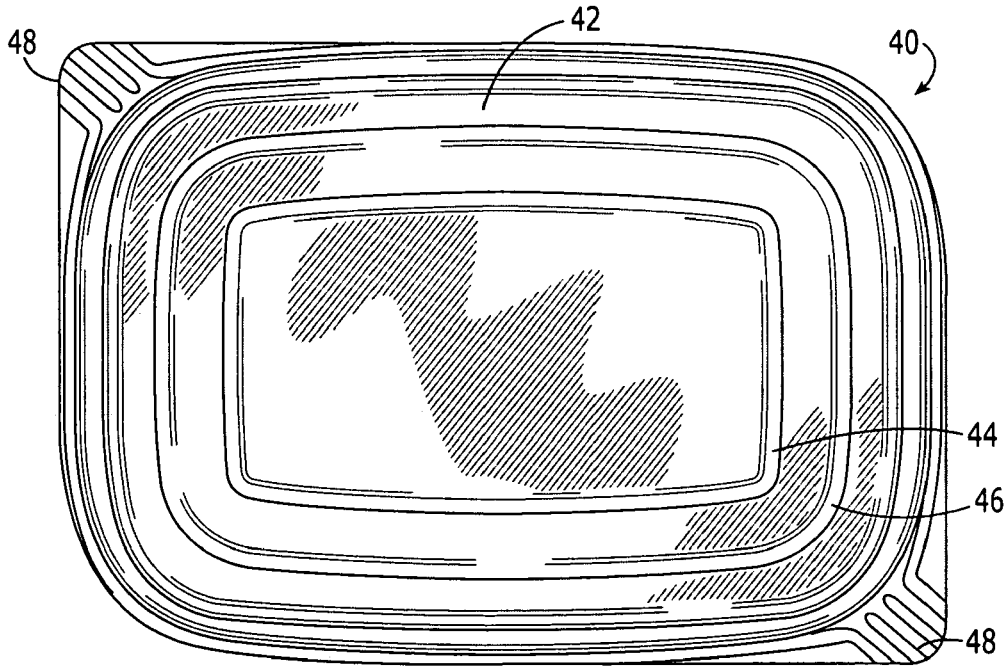
FIG. 2 (PRIOR ART)
FIG. 2 is a top plan view of a prior art container lid adapted to sealably engage the container bottom shown in FIG. 1.

Referring now to FIG. 2, there is shown a container lid 40 that is adapted to sealingly engage the container bottom 12 discussed above. As illustrated in FIG. 2, the container lid 40 has a top surface 42, a bottom surface (not shown), an inner stacking bead 44, an outer stacking bead 46, gripping tabs 48 and a closure device 49 that is adapted to cooperate with the closure device 24 of the container bottom 12 (see FIG. 4).

The inner stacking bead 44 preferably runs continuously along the bottom surface of the lid 40, forming a substantially rectangular ring. The outer stacking bead 46 also runs continuously along the bottom surface of the lid 40, forming a substantially rectangular ring outside the perimeter of the inner stacking bead 44 and inside the perimeter of the closure device 49.

The inner stacking bead 44 of the container lid 40 is preferably adapted to fit within the stacking recess 20 of the container bottom 12. The outer bead 44 is designed to secure the perimeter of the bottom surface 14 of the container bottom 12. The stacking beads 44, 46 keep the closed containers (i.e., container bottom 12 and lid 40 assemblies) in vertical alignment when placed in a stacked position thereby minimizing shelf space within a cabinet, refrigerator or freezer while providing for a stable stack.

Further details of the container lid 40, and container bottom 12 and lid 40 assemblies, are similarly set forth in the '696 patent.

Referring now to FIGS. 5 through 8, there is shown one embodiment of the stackable container lid 50 of the invention. As stated, although the container stacking means of the invention are described with respect to the illustrated lids, the stacking means can be incorporated into and/or employed with most, if not all, container lids. Further, unless stated otherwise, the stackable container lids of the invention preferably comprise polyolefin or a like material.

Figure 5:
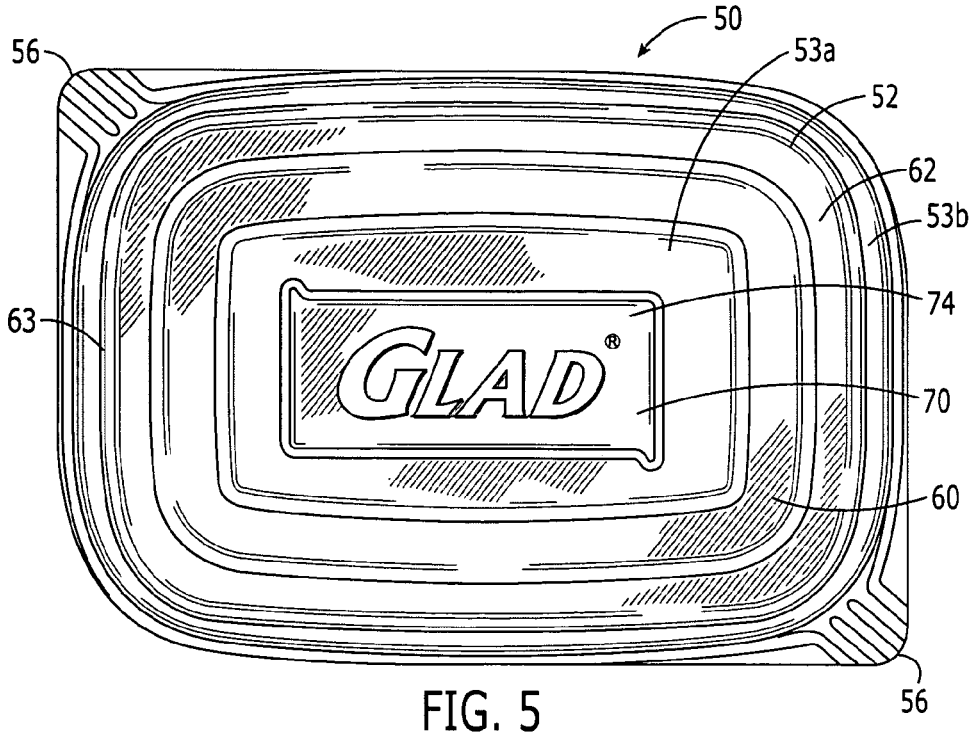
FIG. 5 is a top plan view of one embodiment of a stackable container lid, according to the invention.
Figure 7:
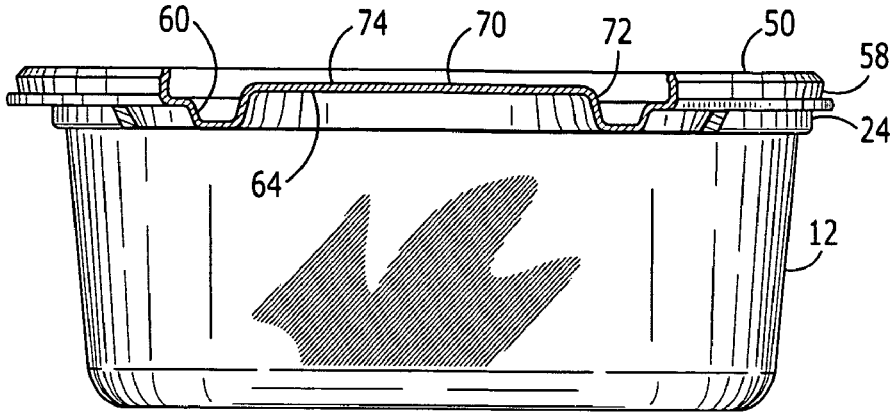
FIG. 7 is a side elevation view of container bottom having the container lid shown in FIG. 5 sealably engaged thereto, according to the invention.
Figure 8:
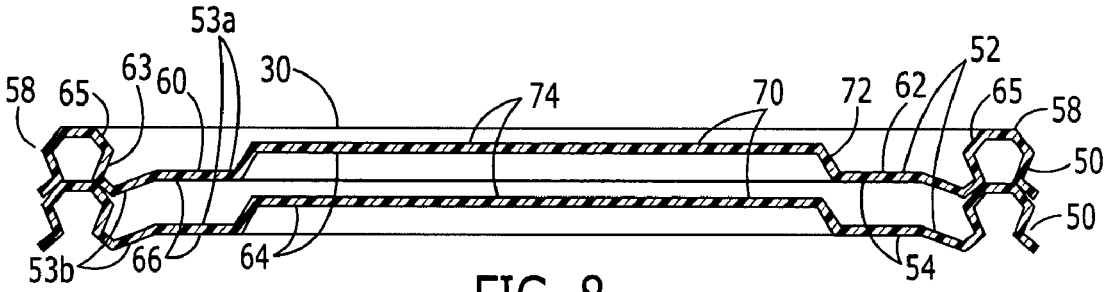
FIG. 8 is a side elevation view of a plurality of the container lids shown in FIG. 5 in an aligned, pre-engaged orientation, according to the invention.

As illustrated in FIGS. 5 and 8, the lid 50 similarly includes a center portion 53*a*, an edge portion 53*b*, top and bottom surfaces 52, 54, gripping tabs 56 and closure means 58 adapted to cooperate with the closure device 24 of the container bottom 12 (see FIG. 7). In a preferred embodiment, the lid 50 further includes a stacking recess 60 and an embossed region (or "engagement member") 70 disposed therein.

The stacking recess 60 is preferably rectangular in shape, having a length in the range of approximately 3.0-12.0 in. and a width in the range of approximately 2.0-10.0 in. However, as will appreciated by one having ordinary skill in the art, the stacking recess 60 can comprise various additional configurations and sizes, such as the substantially circular recess 124 shown in FIGS. 20 and 21.

Figure 6:
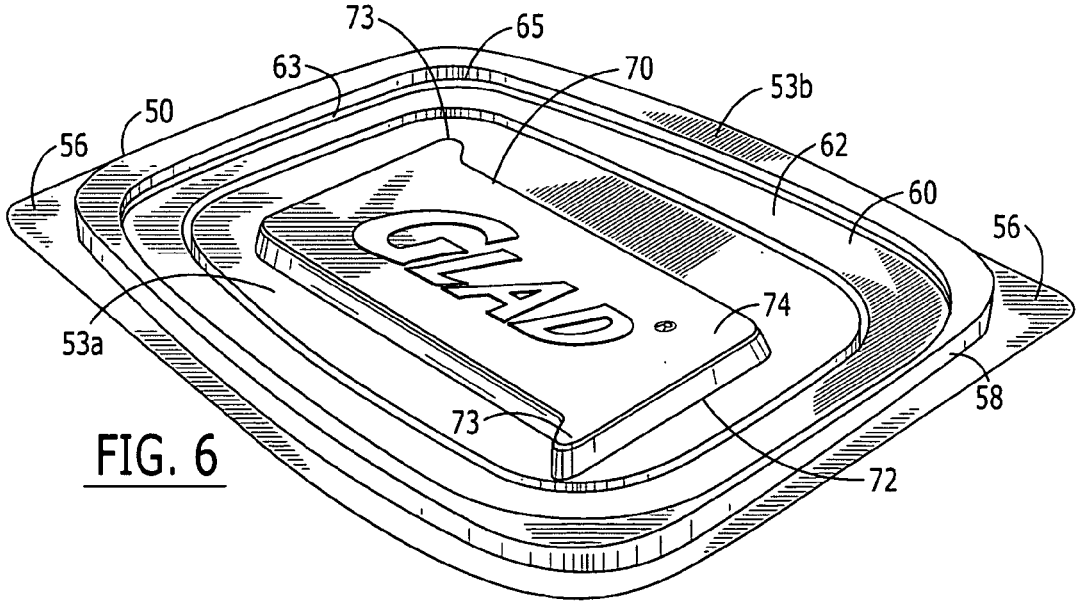
FIG. 6 is a perspective view of the container lid shown in FIG. 5.

As further illustrated in FIGS. 6 and 8, the stacking recess 60 includes a substantially planar surface 62 and an inner wall 63. In a preferred embodiment, the inner wall 63 is slightly tapered inwardly with respect to the recess surface 62 to facilitate engagement of the lid closure means 58 to the container closure device 24.

As illustrated in FIG. 8, in a preferred embodiment, the inner wall 63 includes a lead-in portion 65 disposed proximate the opening of the stacking recess 60. The lead-in portion 65 is preferably tapered outwardly with respect to the inner wall 63 and, hence, recess surface 62.

Referring back to FIGS. 5 and 6, the embossed region 70 of the lid 50 is similarly substantially rectangular in shape, having a length in the range of approximately 1.0-3.0 in. and a width in the range of approximately 0.500-2.0 in. However, the embossed region 70 can similarly comprise various additional configurations (e.g., square, circular, etc.) and sizes; provided, the recessed bottom region 64 (discussed below) has a correspondingly similar configuration and size (see FIG. 8).

In a preferred embodiment, the embossed region 70 has a height in the range of approximately 0.125-0.500 in. More preferably, the embossed region 70 has a height in the range of approximately 0.125-0.250 in.

As illustrated in FIGS. 6 and 8, the embossed region 70 includes a substantially continuous wall 72 and a top surface 74, which is preferably substantially planar. In a preferred embodiment, the wall 72 preferably includes at least one, more preferably, two locator or positioning tabs 73 that project outwardly from the wall 72 (see FIG. 6).

To facilitate stacking of the lids 50, the wall 72 is preferably slightly tapered inwardly with respect to the recess surface 62 (see FIG. 8). In a preferred embodiment, the wall 72 forms an angle in the range of approximately 95-120° with respect to the recess surface 62.

In an additional envisioned embodiment of the invention, not shown, the wall 72 has a slightly curved shape (i.e., curved inwardly) to similarly facilitate stacking of the lids 50.

Figure 9:
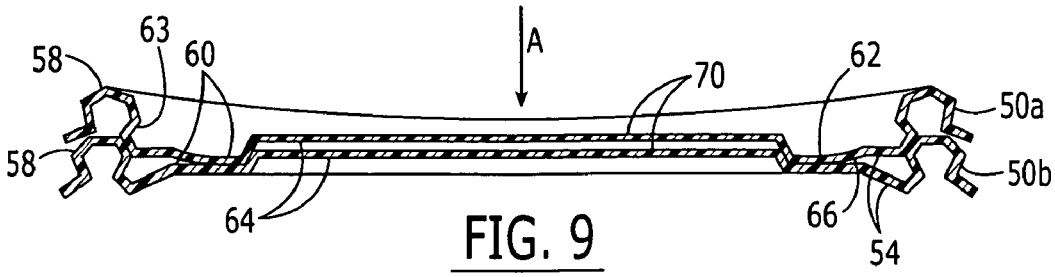
FIG. 9 is a side elevation view of a plurality of the container lids shown in FIG. 5 in a stacked, engaged orientation, according to the invention.

Referring now to FIGS. 8 and 9, there is shown a plurality of similarly sized and configured lids 50*a*, 50*b* in an aligned, pre-engaged orientation (see FIG. 8) and a stacked, engaged orientation (see FIG. 9). As will be appreciated by one having ordinary skill in the art, notwithstanding the unique engagement means of the invention, the lids 50*a*, 50*b* can be readily "stripped" during the manufacturing and packaging processes when disposed in the aligned, pre-engaged orientation illustrated in FIG. 8.

Referring now to FIG. 9, to engage the lids 50*a*, 50*b*, the aligned lids 50*a*, 50*b* are merely held in a stationary position, e.g., placed on a container or table or held in a person's hand, and a force is applied in a direction generally denoted by arrow A proximate the embossed region 70. According to the invention, by virtue of the designed cooperation by and between the embossed region 70 and recessed bottom region 64 of another lid (discussed below) and the lid material, the noted engagement force can readily be applied by a person's finger or palm.

As illustrated in FIG. 9, in the noted stacked, engaged orientation the recessed bottom region 64 of each lid 50*a*, 50*b* is configured and sized to receive therein and substantially complement the embossed region 70 of another lid (e.g., 50*b*) positioned below (i.e., bottom lid). The stacking recess 60 of the lids 50*a*, 50*b* is also configured and sized to receive the lid stacking seat 66 (that is also disposed on the bottom of each lid 50*a*, 50*b*) of another lid positioned on top (e.g., lid 50*a*).

Figure 10:
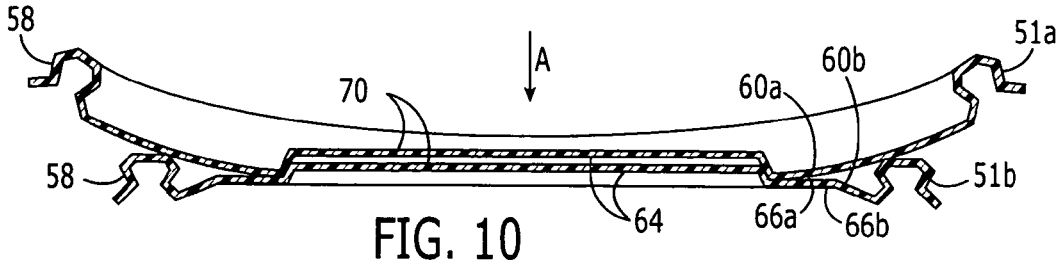
FIG. 10 is a side elevation view of a plurality of dissimilar container lids having similar engagement means as the lids shown in FIG. 8 in a stacked, engaged orientation, according to the invention.

Referring now to FIG. 10, there is shown a plurality of dissimilar lids 51*a*, 51*b*, in a stacked, engaged orientation. Although each lid 51*a*, 51*b* has a different size (i.e., different outer dimension), each lid 51*a*, 51*b* similarly includes an embossed region 70, a recessed bottom region 64, a stacking recess 60*a*, 60*b* and lid stacking seat 66*a*, 66*b*.

Thus, in the noted stacked, engaged orientation the recessed bottom region 64 of each lid 51*a*, 51*b* similarly receives therein the raised region 70 of another lid (e.g., 51*b*) positioned below. The stacking recess 60*b* of lid 51*b* also receives the lid seat 66*a* of lid 51*a* positioned on top.

As will be appreciated by one having ordinary skill in art, the retention force of the engaged lids (e.g., 50*a*, 50*b*) will vary with the amount or degree of engagement force. The retention force can also be tailored by varying the taper of the embossed region wall 72 and/or the height of the embossed region 70. Preferably, the retention force is in the range of approximately 0.25-5 lbs.

According to the invention, to enhance pre-alignment (and, hence, facilitate engagement) of the stackable lids of the invention, the height of the embossed region 70 can be increased such that the embossed region 70 is partially disposed in the recessed bottom region 64 of a like lid positioned on top when the lids are in an aligned, pre-engaged orientation, such as illustrated in FIG. 8. However, as will be appreciated by one having ordinary skill in the art, it is preferred that the height of the embossed region 70 is not increased to a level that would substantially impede stripping of the lids.

Figure 11:
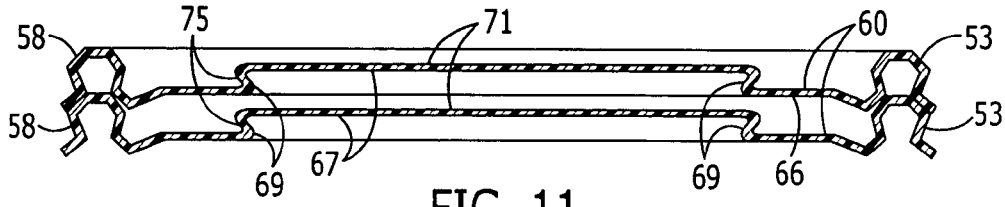
FIG. 11 is a side elevation view of a plurality of the container lids in an aligned, pre-engaged orientation, illustrating a further embodiment of the lid shown in FIG. 5, according to the invention.
Figure 12:
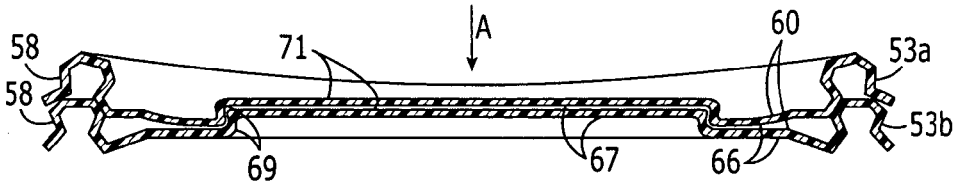
FIG. 12 is a side elevation view of a plurality of the container lids shown in FIG. 11 in a stacked, engaged orientation, according to the invention.
Figure 13:
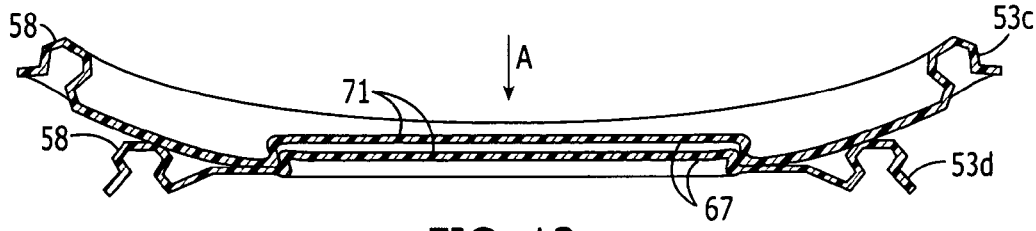
FIG. 13 is a side elevation view of a plurality of dissimilar container lids having similar engagement means as the lids shown in FIG. 11 in a stacked, engaged orientation, according to the invention.

Referring now to FIGS. 11-13, there is shown an additional embodiment of the lids 50, 50*a*, 50*b*, shown in FIGS. 8 and 9. As illustrated in FIG. 11, in the noted embodiment, the embossed region 71 of the lid 53 includes an under-cut wall 75 and the recessed bottom region 67 includes a wall 69 having a correspondingly similar configuration that is adapted to cooperate with the wall 75 of a like lid 53 when, as discussed below, the lids 53 are in an engaged orientation.

As illustrated in FIG. 12, the lids 53*a*, 53*b* are similarly engaged by holding the lids 53*a*, 53*b* in a stationary position and exerting a force on the top lid 53*a* proximate the embossed region 71, whereby the recessed bottom region 67 of lid 53*a* receives and engages the embossed region 71 of lid 53*b*.

As illustrated in FIG. 13, the noted embossed region 71 and recessed bottom region 67 can similarly be provided on dissimilar lids 53*c*, 53*d* to facilitate engagement and, hence, stacking thereof.

As will be appreciated by one having ordinary skill in the art, the noted embossed region 71 and recessed bottom region 67 will enhance the retention of the engaged lids (e.g., 53*a*, 53*b*). As will further be appreciated by one having ordinary skill in the art, the under-cut wall 71 of the embossed region 71 and the wall 69 of the recessed region 67 can also be configured and tailored to provide a desired retention force and, hence, release force.

Figure 14:
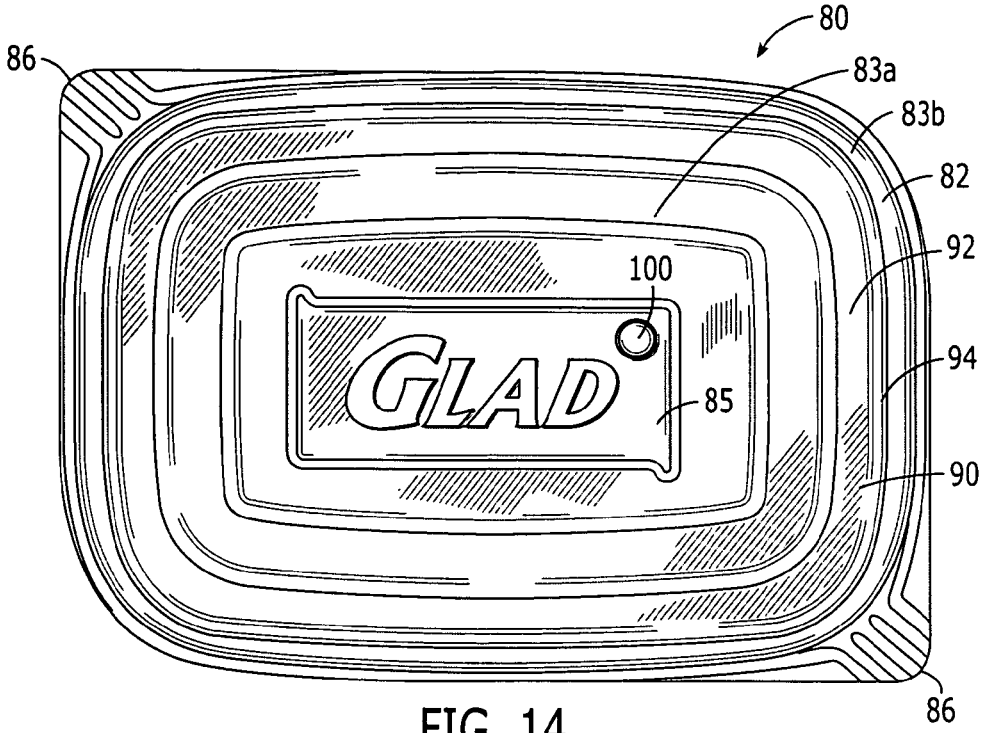
FIG. 14 is a top plan view of another embodiment of a stackable container lid, according to the invention.
Figure 17:
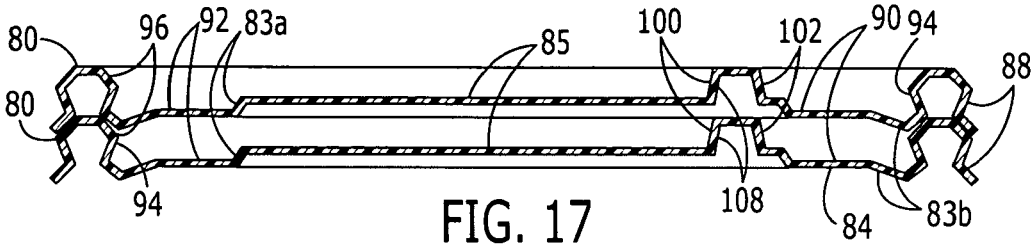
FIG. 17 is a side elevation view of a plurality of the container lids shown in FIG. 14 in an aligned, pre-engaged orientation, according to the invention.

Referring now to FIGS. 14 through 17, there is shown another embodiment of a stackable container lid 80 of the invention. As illustrated in FIGS. 14 and 17, the lid 80 similarly includes an inner portion 83*a*, an edge portion 83*b*, top and bottom surfaces 82, 84, an embossed region 85 that is disposed on the top surface 82, which, in this embodiment, has a lower height, gripping tabs 86 and closure means 88 adapted to cooperate with the closure device 24 of the container bottom 12 (see FIG. 16). In a preferred embodiment, the lid 80 further includes a stacking recess 90 and a raised boss 100 that projects outwardly from the top surface 82.

According to the invention, the raised boss 100 can be positioned at any location proximate to or on the embossed region 85 or within the stacking recess 90. As illustrated in FIGS. 14 and 17, in one embodiment of the invention, the raised boss 100 is disposed on the embossed region 85.

In the noted embodiment, the stacking recess 90 is similarly preferably rectangular in shape. The stacking recess 90 can, however, similarly comprise various additional configurations and sizes.

Figure 15:
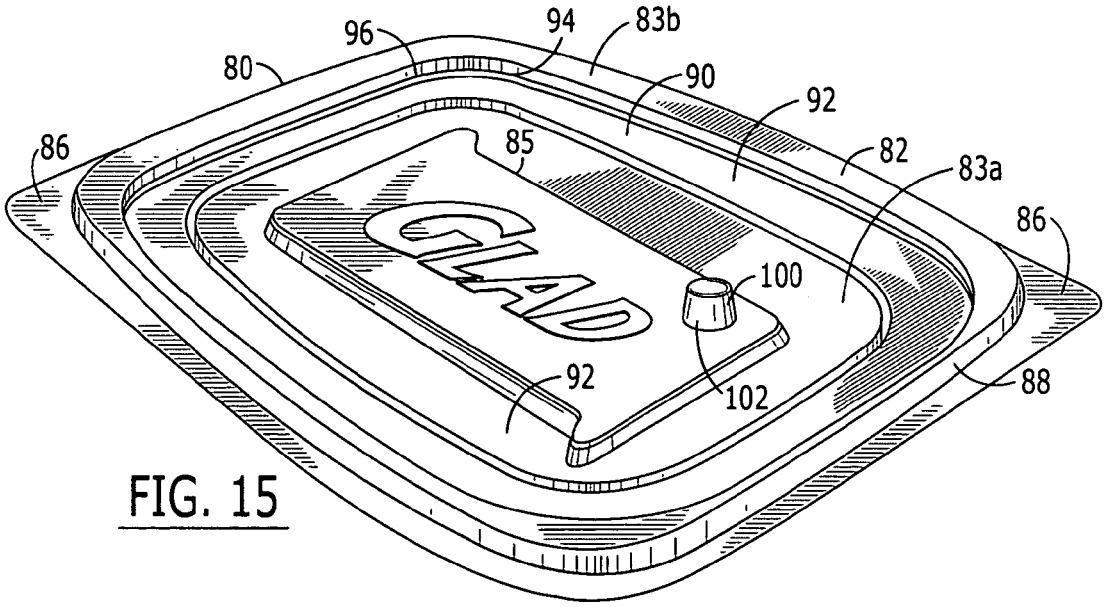
FIG. 15 is a perspective view of the container lid shown in FIG. 14.
Figure 16:
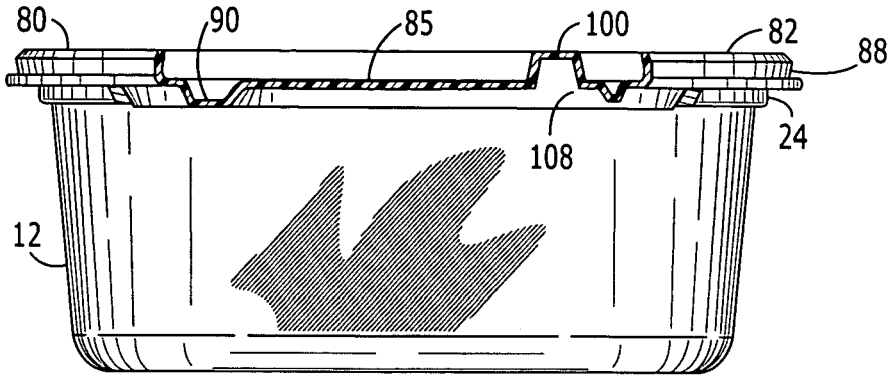
FIG. 16 is a side elevation view of container bottom having the container lid shown in FIG. 14 sealably engaged thereto, according to the invention.

Referring to FIGS. 15 and 17, the stacking recess 90 includes a substantially planar surface 92 and an inner wall 94. In a preferred embodiment, the inner wall 94 is similarly slightly tapered inwardly with respect to the recess surface 92.

In a preferred embodiment, the inner wall 94 similarly includes a lead-in portion 96 disposed proximate the opening of the stacking recess 90. The lead-in portion 96 is preferably tapered outwardly with respect to the inner wall 94 and, hence, recess surface 92.

Referring back to FIGS. 15 and 17, the raised boss 100 is preferably substantially cylindrical in shape, having a mean diameter in the range of approximately 0.500-2.0 in., more preferably, in the range of approximately 0.500-1.0 in. However, the raised boss 100 can similarly comprise various additional configurations (e.g., square) and sizes; provided, the boss seat 108 (discussed below) has a corresponding configuration and size (see FIG. 18).

In a preferred embodiment, the raised boss 100 has a height in the range of approximately 0.125-0.500 in. More preferably, the raised boss 100 has a height in the range of approximately 0.125-0.250 in.

As illustrated in FIGS. 15 and 17, the raised boss 100 includes a substantially continuous wall 102. To facilitate engagement and, hence, stacking of the lids 80, the wall 102 is preferably slightly tapered inwardly with respect to the recess surface 92. In a preferred embodiment, the wall 102 forms an angle in the range of 95-120° with respect to the recess surface 92.

Figure 18:
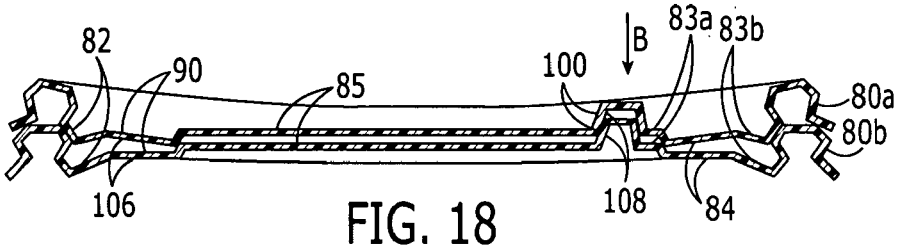
FIG. 18 is a side elevation view of a plurality of the container lids shown in FIG. 14 in a stacked, engaged orientation, according to the invention.

Referring now to FIGS. 17 and 18, there is shown a plurality of similarly sized and configured lids 80*a*, 80*b* in an aligned, pre-engaged orientation (see FIG. 17) and a stacked, engaged orientation (see FIG. 18). To engage the lids 80*a*, 80*b*, the aligned lids 80*a*, 80*b* are similarly held in a stationary position, e.g., placed on a counter or table or held in a person's hand, and a force is applied in a direction generally denoted by arrow B proximate the raised boss 100. The noted engagement force can similarly be readily applied by a person's finger or palm.

As illustrated in FIG. 18, in the noted stacked, engaged orientation the boss seat 108 of each lid 80*a*, 80*b* is configured and sized to receive therein and substantially complement the raised boss 100 of another like lid (e.g., 80*b*) positioned below. The stacking recess 90 of the lids 80*a*, 80*b* is also configured and sized to receive the lid stacking seat 106 (that is also disposed on the bottom of each lid 80*a*, 80*b*) of another like lid positioned on top (e.g., lid 80*a*).

Figure 19:
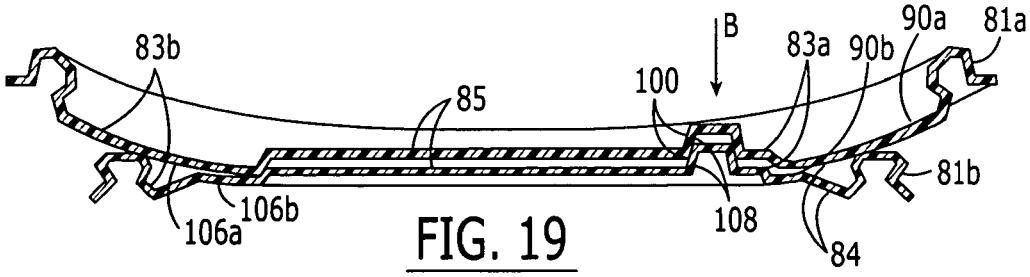
FIG. 19 is a side elevation view of a further plurality of dissimilar container lids in a stacked, engaged orientation, according to the invention.

Referring now to FIG. 19, there is shown a plurality of dissimilar lids 81*a*, 81*b* in a stacked, engaged orientation. As illustrated in FIG. 19, although each lid 81*a*, 81*b* has a different size (i.e., different outer dimension), each lid 81*a*, 81*b* similarly includes a raised boss 100, boss seat 108, stacking recess 90*a*, 90*b*, and lid stacking seat 106*a*, 106*b*.

Thus, in the noted stacked, engaged orientation the boss seat 108 of each lid 81*a*, 81*b* similarly receives therein the raised boss 100 of another lid (e.g., 81*b*) positioned below. The stacking recess 90*b* of lid 81*b* also receives the lid stacking seat 106*a* of lid 81*a* positioned on top.

As will be appreciated by one having ordinary skill in the art, the retention force of the engaged lids (e.g., 80*a*, 80*b*) will similarly vary with the amount or degree of engagement force. The retention force can also be tailored by varying the size and/or wall taper of the raised boss 100 and/or providing an under-cut boss wall. Preferably, the retention force is similarly in the range of approximately 0.25-5 lbs.

According to the invention, to enhance pre-alignment (and, hence, facilitate engagement) of the stackable lids shown in FIGS. 14-18, the height of the raised boss 100 can similarly be increased such that the raised boss 100 is partially disposed in the boss seat 108 of a like lid positioned on top when the lids are in an aligned, pre-engaged orientation, such as illustrated in FIG. 17. However, as noted above, it is preferred that the height of the raised boss 100 is not increased to a level that would substantially impede stripping of the lids.

Figure 20:
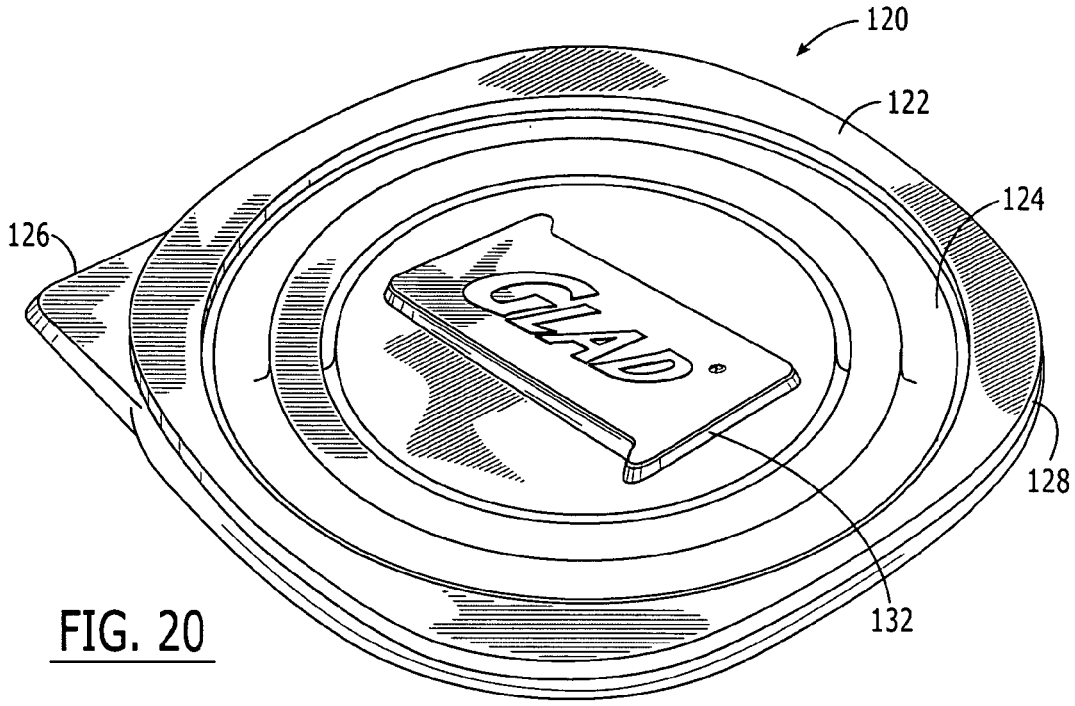
FIG. 20 is a perspective view of another embodiment of a stackable container lid, according to the invention.
Figure 21:
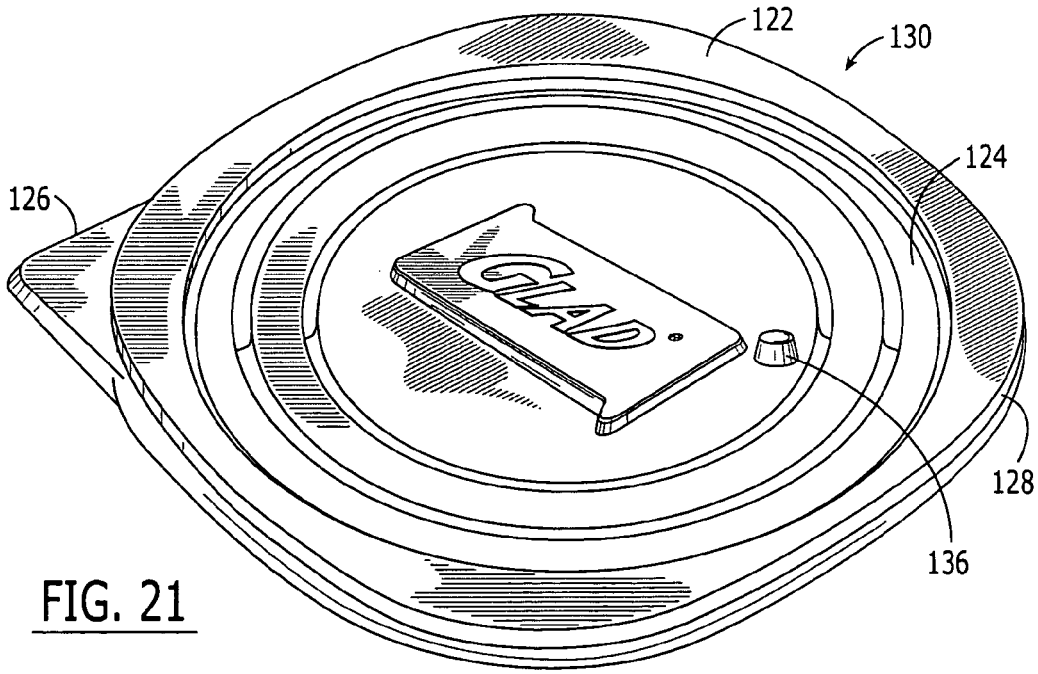
FIG. 21 is a perspective view of yet another embodiment of a stackable container lid, according to the invention.

Referring now to FIGS. 20 and 21, there are shown additional embodiments of stackable container lids 120, 130. With the exception of the substantially circular recess 124, each lid 120, 130 includes the design features of lids 50, 80, discussed above.

As illustrated in FIGS. 20 and 21, each lid 120, 130 thus similarly includes a top surface 122, a bottom surface (not shown), at least one gripping tag 126 and closure means 128 adapted to cooperate with the closure device of a container bottom having a corresponding configuration and size.

Referring to FIG. 20, the illustrated lid 120 similarly includes an embossed region 132 that is received by the recessed region of another like lid 120 when the lids are in a stacked, engaged orientation.

Referring to FIG. 21, in the illustrated embodiment, the lid 130 similarly includes a raised boss 136 that is received by the boss seat of another like lid 130 when the lids 130 are in a stacked, engaged orientation.

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims.

What is claimed is:

1. A stackable container lid for a container having a closure device, comprising:

a lid member having a center portion, top and bottom surfaces and continuous peripheral closure means surrounding said center portion and adapted to cooperate with the closure device of the container, said lid top surface including an engagement member, said engagement member being disposed in said lid member center portion and projecting outwardly from said top surface, said lid bottom surface including a recessed bottom region, wherein adjacently stacked lids in a vertically aligned lid stack are configurable between a first pre-engaged orientation and a second engaged orientation, wherein said engagement member of a first of said lid is received within said recessed bottom region of a second of said lid when configured in said second engaged orientation, and whereby configuration in said first pre-engaged orientation permits slidable separation of one or more of said lids from said lid stack in a separation direction transverse to a stacking direction of said lid stack.

2. The container lid of claim 1, wherein said lid bottom surface includes a lid stacking seat.

3. The container lid of claim 2, wherein said lid top surface includes a stacking recess that is adapted to receive said lid stacking seat of another said lid.

4. The container lid of claim 3, wherein said stacking recess is substantially rectangular in shape.

5. The container lid of claim 4, wherein said stacking recess has a length in the range of approximately 3.0-12.0 in. and a width in the range of approximately 2.0-10.0 in.

6. The container lid of claim 3, wherein said stacking recess is substantially circular in shape.

7. The container lid of claim 3, wherein said stacking recess includes a substantially planar surface and an inner wall.

8. The container lid of claim 7, wherein said inner wall is tapered inwardly with respect to said recess surface.

9. The container lid of claim 1, wherein said engagement member and said recessed bottom region of another said lid are engagable by exerting a force on said lid top surface of said another lid proximate said engagement member of said another lid.

10. The container lid of claim 9, wherein said engagement member is adapted to cooperate with said recessed bottom region of another said lid to provide self-alignment means for aligning said lids when said lids are in said pre-engaged orientation.

11. The container lid of claim 1, wherein said engagement member is substantially rectangular in shape.

12. The container lid of claim 11, wherein said engagement member has a length in the range of approximately 1.0-3.0 in. and a width in the range of approximately 0.5-2.0 in.

13. The container lid of claim 1, wherein said engagement member has a height in the range of approximately 0.125-0.500 in.

14. The container lid of claim 1, wherein said engagement member has a height in the range of approximately 0.125-0.250 in.

15. The container lid of claim 1, wherein said engagement member includes a substantially continuous wall.

16. The container lid of claim 15, wherein said engagement member wall is tapered inwardly with respect to said recess surface.

17. The container lid of claim 16, wherein said engagement member wall form an angle in the range of approximately 95-120° with respect to said recess surface.

18. A stackable container lid for a container having a closure device, comprising:

a lid member having a center portion, top and bottom surfaces and continuous peripheral closure means surrounding said center portion and adapted to cooperate with the do sure device of the container, said lid top surface including an engagement member, said engagement member being disposed in said lid member center portion and projecting outwardly from said top surface, said lid bottom surface including a recessed bottom region, wherein adjacently stacked lids in a vertically aligned lid stack ale configurable between a first pre-engaged orientation and a second engaged orientation, whereby configuration in said first pre-engaged orientation permits slidable separation of one or more of said lids from said lid stack in a separation direction transverse to a stacking direction of said lid stack, and wherein said engagement member of a first of said lid is receivingly engaged within said recessed bottom region of an adjacently stacked lid when configured in said second engaged orientation, said engagement member and said recessed bottom region of another of said lid being engageable by exerting a force on said lid top surface of said another lid proximate said engagement member of another said lid.

19. The container lid of claim 18, wherein said lid bottom surface includes a lid stacking seat.

20. The container, lid of claim 19, wherein said lid top surface includes a stacking recess that is adapted to receive said lid stacking seat of another said lid when said force is applied to said lid top surface of said another lid.

21. The container lid of claim 18, wherein said stacking recess is substantially rectangular in shape.

22. The container lid of claim 18, wherein said stacking recess is substantially circular in shape.

23. The container lid of claim 18, wherein said stacking recess includes a substantially planar surface and an inner wall, said inner wall being tapered inwardly with respect to said recess surface.

24. The container lid of claim 18, wherein said engagement member is substantially rectangular in shape.

25. The container lid of claim 18, wherein said engagement member has a height in the range of approximately 0.125-0.500 in.

26. The container lid of claim 18, wherein said engagement member includes a substantially continuous wall, said wall being tapered inwardly with respect to said recess surface.

27. A stackable container lid for a container having a closure device, comprising:

a lid member having an inner portion, top and bottom surfaces and continuous peripheral closure means surrounding said inner portion and adapted to cooperate with the closure device of the container, said lid top surface including a stacking boss, said stacking boss being disposed in said lid member inner portion and projecting outwardly from said top surface, the lid bottom surface including a boss seat, wherein adjacently stacked lids in a vertically aligned lid stack are configurable between a first pre-engaged orientation and a second engaged orientation, wherein said stacking boss of a first of said lid is received within said boss seat of a second of said lid when configured in said second engaged orientation, and whereby configuration in said first pre-engaged orientation permits slidable separation of one or more of said lids from said lid stack in a separation direction transverse to the stacking direction of said lid stack.

28. The container lid of claim 27, wherein said stacking boss and said boss seat of another said lid are engagable by exerting a force on said lid top surface of said another lid proximate said stacking boss of said another lid.

29. The container lid of claim 28, wherein said lid top surface includes a stacking recess that is adapted to receive said lid stacking seat of said another lid.

30. The container lid of claim 29, wherein said stacking recess is substantially rectangular in shape.

31. The container lid of claim 30, wherein said stacking recess includes a substantially planar surface and an inner wall.

32. The container lid of claim 31, wherein said inner wall is tapered inwardly with respect to said recess surface.

33. The container lid of claim 29, wherein said stacking recess is substantially circular in shape.

34. The container lid of claim 27, wherein said lid bottom surface includes a lid stacking seat.

35. The container lid of claim 27, wherein said stacking boss is substantially cylindrical in shape.

36. The container lid of claim 35, wherein said stacking boss has a mean diameter in the range of approximately 0.500-2.0 in.

37. The container lid of claim 27, wherein said stacking boss has a height in the range of approximately 0.125-0.500 in.

38. The container lid of claim 27, wherein said stacking boss has a height in the range of approximately 0.125-0.250 in.

39. The container lid of claim 27, wherein said stacking boss has a substantially continuous wall.

40. The container lid of claim 39, wherein said stacking boss wall is tapered inwardly with respect to said recess surface.

41. A stackable container lid for a container having a closure device, comprising:

a lid member having an inner portion, top and bottom surfaces and continuous peripheral closure means surrounding said inner portion and adapted to cooperate with the closure device of the container, said lid top surface including a stacking boss, said stacking boss being disposed in said lid member inner portion and projecting outwardly from said top surface, the lid bottom surface including a boss seat, wherein adjacently stacked lids in a vertically aligned lid stack are configurable between a first pre-engaged orientation and a second engaged orientation, wherein said stacking boss of a first of said lid is received within said boss seat of a second of said lid when configured in said second engaged orientation, and wherein said stacking boss of a first of said lid is receivingly engaged within said boss seat region of an adjacently stacked lid when configured in said second engaged orientation, said stacking boss and said boss seat of another said lid being engagable by exerting a force on said lid top surface of said another lid proximate said stacking boss of said another lid.

42. A method of stacking container lids, comprising the steps of:

providing at least first and second lid members, each of said first and second lid members having a center portion, top and bottom surfaces and continuous peripheral closure means surrounding said center portion, said lid top surface including an engagement member, said engagement member being disposed in said lid member center portion and projecting outwardly from said top surface, said lid bottom surface of said first lid member including a recessed bottom region, said engagement member of said second lid member and said recessed bottom region of said first lid member being engagable by exerting a force on said lid top surface of said first lid member proximate said engagement member of said first lid member;

placing said first and second lid members in a vertically aligned lid stack with said lids configured in a pre-engaged orientation whereby said engagement member of said second lid member and said recessed bottom region of said first lid member are aligned and whereby said lids are slidably separable from one another in a separation direction transverse to a stacking direction of said lid stack; and exerting an engagement force on said lid top surface of said first lid member in said lid stack proximate said engagement member of said first lid member while said second lid member is maintained in a substantially stationary position.

43. The method of claim 42, wherein said first and second lid members have a substantially similar configuration and size.

44. The method of claim 42, wherein said first and second lid members have a dissimilar configuration and size.

* * * * *